US007999202B2

(12) United States Patent
Fujita et al.

(10) Patent No.: US 7,999,202 B2
(45) Date of Patent: Aug. 16, 2011

(54) CONTACT

(75) Inventors: Daisuke Fujita, Tokyo (JP); Hitoshi Sadakuni, Tokyo (JP); Hiroyuki Nakagawa, Tokyo (JP); Hideaki Shimazu, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 126 days.

(21) Appl. No.: 12/594,964

(22) PCT Filed: Apr. 14, 2008

(86) PCT No.: PCT/JP2008/057289

§ 371 (c)(1),
(2), (4) Date: Oct. 7, 2009

(87) PCT Pub. No.: WO2009/128134

PCT Pub. Date: Oct. 22, 2009

(65) Prior Publication Data

US 2011/0124245 A1 May 26, 2011

(51) Int. Cl.
*H01H 1/06* (2006.01)
*H01R 13/33* (2006.01)

(52) U.S. Cl. ..... 200/275; 439/840

(58) Field of Classification Search ..... 200/275; 439/349, 827, 788, 352, 840, 909; 267/166; 607/36–38

See application file for complete search history.

(56) References Cited

U.S. PATENT DOCUMENTS

| | | | | |
|---|---|---|---|---|
| 3,818,421 | A | 6/1974 | Kruger | |
| 3,911,197 | A | 10/1975 | Kruger | |
| 4,805,943 | A * | 2/1989 | Balsells | 285/318 |
| 5,474,309 | A | 12/1995 | Balsells | |
| 5,503,375 | A | 4/1996 | Balsells | |
| 5,545,842 | A * | 8/1996 | Balsells | 174/372 |
| 5,807,146 | A | 9/1998 | Baker | |
| 6,835,084 | B2 * | 12/2004 | Poon et al. | 439/349 |
| 7,274,964 | B2 * | 9/2007 | Balsells | 607/37 |
| 7,722,415 | B2 * | 5/2010 | Chansrivong | 439/840 |
| 2004/0175229 | A1 | 9/2004 | Balsells | |

FOREIGN PATENT DOCUMENTS

| | | | |
|---|---|---|---|
| JP | 7-22254 | A | 1/1995 |
| JP | 8-210404 | A | 8/1996 |
| JP | 2006-518090 | A | 8/2006 |
| WO | WO 98/40932 | A1 | 9/1998 |

OTHER PUBLICATIONS

International Search Report (PCT/ISA/210) dated May 23, 2008.
Written Opinion (PCT/ISA/237) dated Jun. 3, 2008.

* cited by examiner

*Primary Examiner* — Edwin A. Leon
(74) *Attorney, Agent, or Firm* — Buchanan Ingersoll & Rooney PC

(57) ABSTRACT

A contact includes a first conductor that has a fitting hole formed therein; a second conductor that has a shaft that can be inserted into the fitting hole and an annular groove formed on an outer circumference of the shaft; and an inclined coil spring that has a ring inserted into a coil, is circularly formed by the ring to be provided inside the annular groove, and is in contact with the annular groove and the fitting hole to electrically connect the first and second conductors. The inclined coil spring is helically wound in a shape of an ellipse and is provided inside the annular groove so that a long axis of the ellipse is directed to an axial direction of the shaft and a short axis is directed to a radial direction of the shaft. Axial-direction both ends of the ring are in contact with a long-axis inner circumference of the inclined coil spring.

11 Claims, 5 Drawing Sheets

CONTACT

TECHNICAL FIELD

The present invention relates to a contact that electrically connects two conductors in a gas insulated switchgear for use in a high-voltage transmission system while allowing relative displacement between the two conductors by thermal expansion.

BACKGROUND ART

There has been conventionally known a spring apparatus that gives electrical conductivity includes a coil spring and end coils. The coil spring has two ends and a plurality of intermediate coils canted along a centerline of the coil spring. Each of the intermediate coils has a leading portion disposed at a front angle to a normal line to the centerline and a trailing portion disposed at a back angle to the normal line. The end coils are congruent with the plurality of intermediate coils, are disposed at the two ends, have back angle means, and define a trailing portion of at least one of the end coils for locking the end coils on one end of the intermediate coils to the end coils on another end of the intermediate coils. The end coil trailing portion of the at least one of the end coils has a back angle different from the intermediate coil trailing portion back angle. The end coils are disposed at positions not interfering with deflection of the intermediate coils. Such a spring apparatus has been disclosed, for example, in Patent Document 1.

Moreover, there has been known a spring holding connector (contact) that includes a housing having a bore therethrough, a shaft rotatably and slidably arranged in the bore, an annular groove formed in one of the bore and shaft, and a circular coil spring disposed in the annular groove for slidably holding the shaft within the bore. The ends of the wire of the coil spring are welded to form a circular form. The groove is sized and shaped for controlling, in combination with a coil spring configuration, shaft mobility within the bore. Such a spring holding connector has been disclosed, for example, in Patent Document 2.

[Patent Document 1] Japanese Patent Application Laid-open No. H8-210404

[Patent Document 2] Japanese Publication of a Translation of an International Application 2006-518090

DISCLOSURE OF INVENTION

Problem to be Solved by the Invention

In the conventional art disclosed in Patent Document 1, to form the circular coil spring by coupling both ends of the coil spring, it is necessary to form the end coils having a shape different from that of the intermediate coils. However, such a circular coil spring is difficult to manufacture and therefore costly.

On the other hand, in the conventional art disclosed in Patent Document 2, the ends of the wire of the coil spring are welded to form a circular coil spring. However, it is difficult to weld the ends of the wire of the coil spring and to secure the reliability. Therefore, there is a problem that the production cost increases and the securing of quality is difficult, similarly to the conventional art disclosed in Patent Document 1.

The present invention has been achieved in view of the above problems, and an object of the invention is to provide a contact with an easy-to-form circular coil spring, excellent reliability, and lower cost.

Means for Solving Problem

To solve the above problems and to achieve the above objects, according to an aspect of the present invention there is provided a contact including a first conductor that has a fitting hole formed therein; a second conductor that has a shaft that can be inserted into the fitting hole and an annular groove formed on an outer circumference of the shaft; and an inclined coil spring that has a ring inserted into a coil, is circularly formed by the ring to be provided inside the annular groove, and is in contact with the annular groove and the fitting hole to electrically connect the first and second conductors.

Effect of the Invention

According to the contact of the present invention, the circular coil spring is easily formed, the reliability is excellent, and the increase of cost can be suppressed.

EXPLANATIONS OF LETTERS OR NUMERALS

10 contact
11 first conductor
11*a* fitting hole
12 second conductor
12*a* shaft
12*b* annular groove
12*c* bottom surface
12*d*, 12*e* lateral surface
13 inclined coil spring
13*a* top portion
13*b* confronting portion
14 insulating ring (ring)
14*a*, 14*b* cut portion

BEST MODE(S) FOR CARRYING OUT THE INVENTION

Exemplary embodiments of a contact according to the present invention will be explained below in detail with reference to the accompanying drawings. The present invention is not limited to the embodiments explained below.

Embodiment

Figure 1:
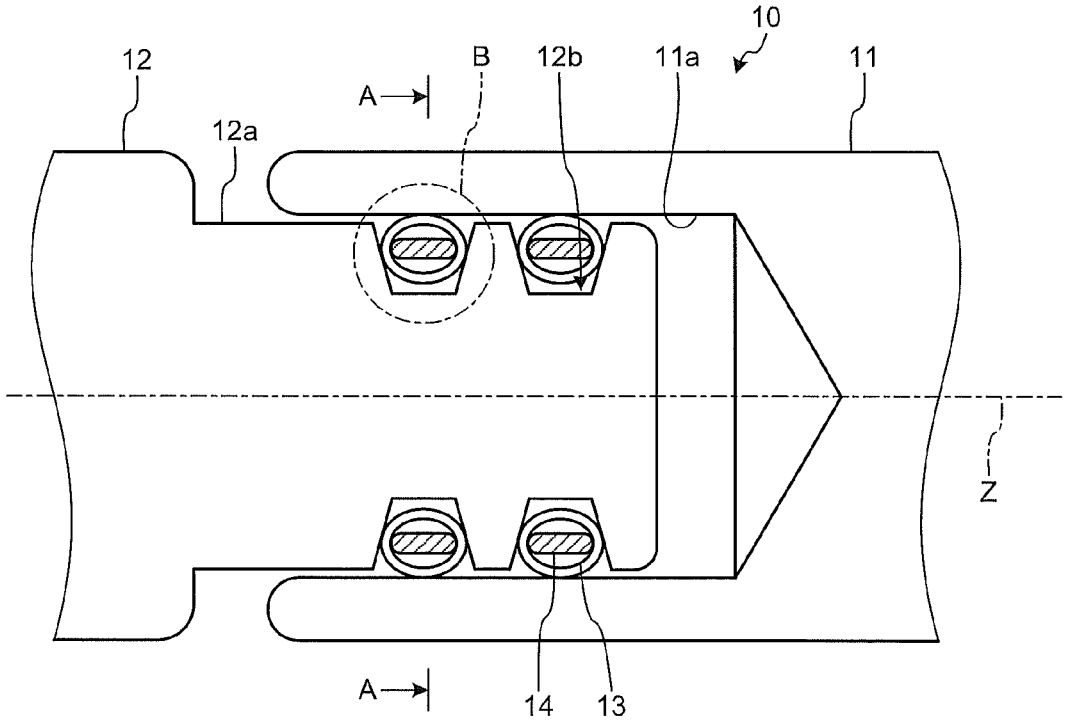
FIG. 1 is a vertical cross-sectional view of a contact along its central axis according to an embodiment of the present invention.
Figure 2:
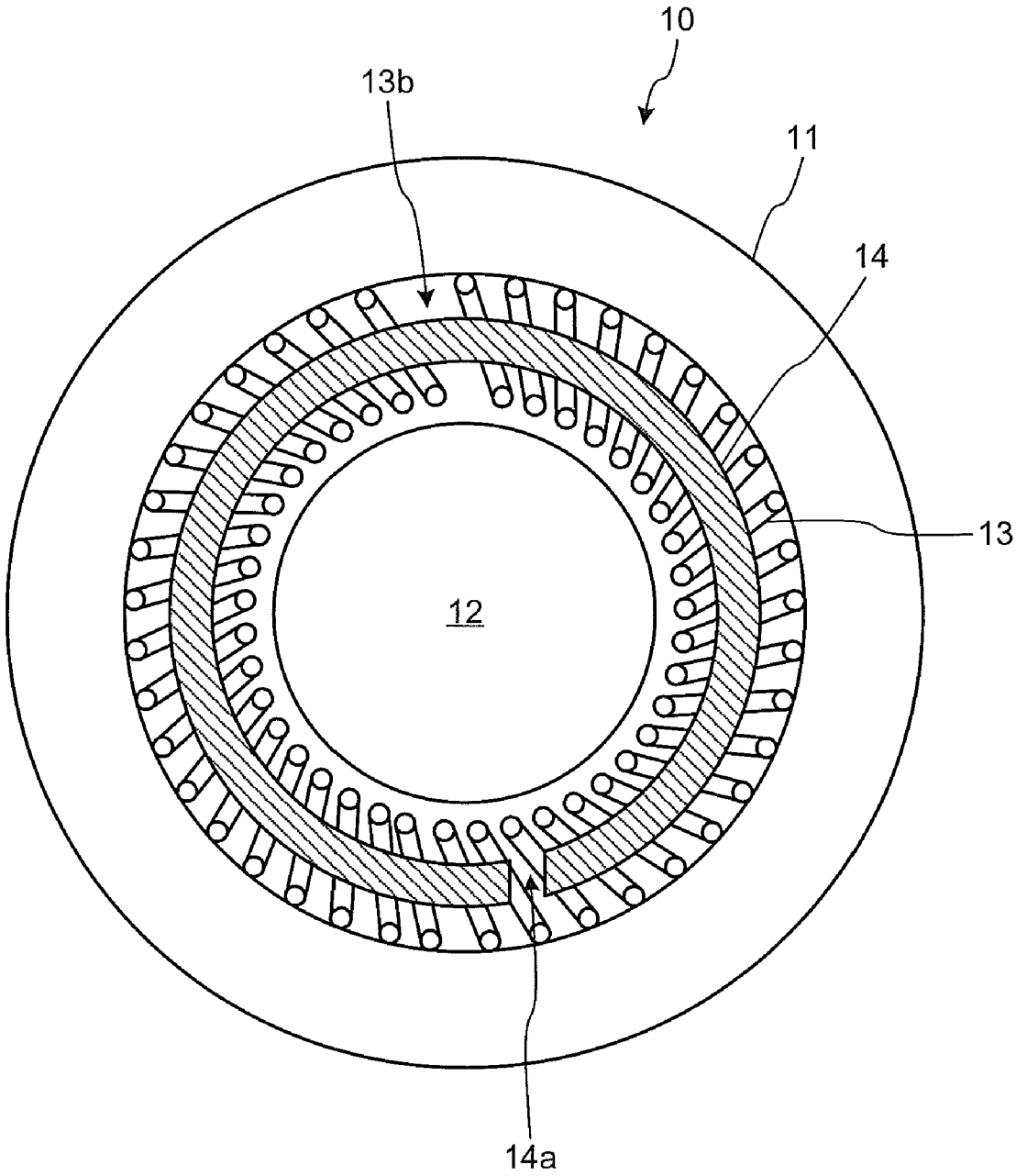
FIG. 2 is a cross-sectional view along an A-A line illustrated in FIG. 1.
Figure 3:
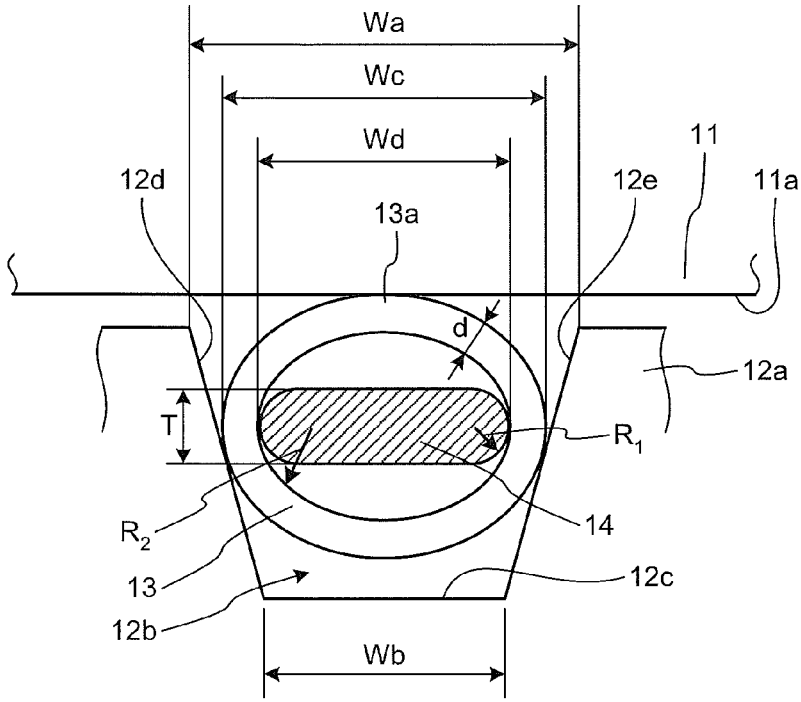
FIG. 3 is an enlarged view of a portion B illustrated in FIG. 1.
Figure 4:
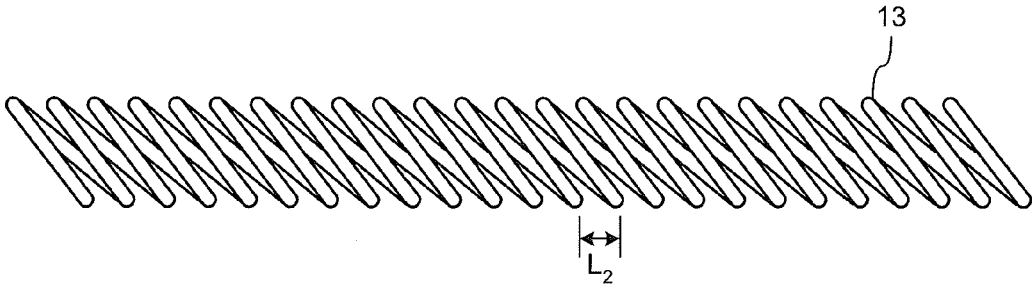
FIG. 4 is a side view of an inclined coil spring according to the embodiment.
Figure 5:
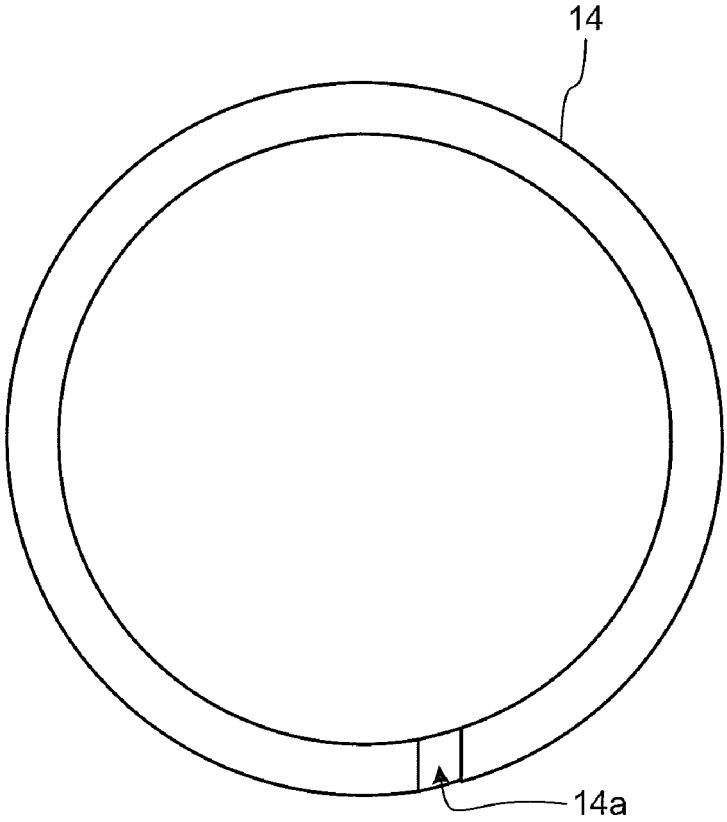
FIG. 5 is a front view of an insulating ring according to the embodiment.
Figure 6:
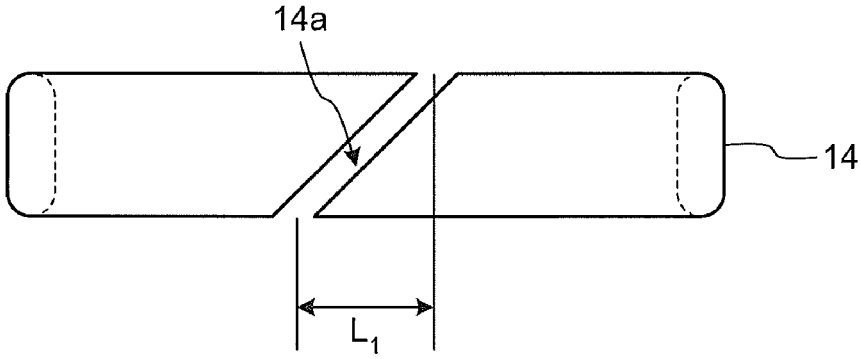
FIG. 6 is a bottom view of the insulating ring according to the embodiment.

FIG. 1 is a vertical cross-sectional view of a contact along its central axis according to an embodiment of the present invention. FIG. 2 is a cross-sectional view along an A-A line illustrated in FIG. 1. FIG. 3 is an enlarged view of a portion B illustrated in FIG. 1. FIG. 4 is a side view of an inclined coil spring according to the embodiment. FIG. 5 is a front view of an insulating ring according to the embodiment. FIG. 6 is a bottom view of the insulating ring according to the embodiment.

As illustrated in FIGS. 1 to 6, a contact 10 according to the embodiment is a device that electrically connects two conductors in a gas insulated switchgear or the like. Such a contact is typically used in a high-voltage transmission system. The contact 10 includes columnar first conductor 11 and second conductor 12, and two coil springs 13. The first conductor 11 has a circular fitting hole 11*a* at one end thereof. The second conductor 12 has a shaft 12*a*, which can be inserted into the fitting hole 11*a* of the first conductor 11. That is, the outside diameter of the shaft 12*a* is smaller than the inner diameter of the fitting hole 11*a*. Two annular grooves 12*b* are formed on an outer circumference of the shaft 12*a*. The inclined coil springs 13 are arranged in the annular grooves 12*b*. The inclined coil springs 13 have an insulating ring 14 inserted into a coil. The inclined coil spring 13 is held in a circular shape by virtue of the rigidity of the insulating ring 14. The inclined coil springs 13 is in electrical contact with the annular groove 12*b* and inner wall of the fitting hole 11*a* of the first conductor 11. As a result, the first and second conductors 11 and 12 are in electrical contact with each other. The insulating ring 14 has rigidity by which the inclined coil spring 13 is held in a circular shape.

It is not necessary to connect both ends of the inclined coil spring 13 by welding in this configuration. Moreover, use of the insulating ring 14, which is cheaper, will lead to a large reduction in cost as compared to the conventional ring disclosed in Patent Document 1 or 2. Furthermore, because the distortion of the inclined coil spring 13 does not occur due to weld and it is not necessary to perform a heat treatment. As a result, the quality and reliability of the inclined coil spring 13 can be improved.

The first and second conductors 11 and 12 are made of any of copper, a copper alloy, aluminum, and an aluminum alloy. The first and second conductors 11 and 12 are also plated with silver to raise their surface electrical conductivity. The inclined coil spring 13 is made of a copper alloy that is excellent in spring property. In consideration of the stability of electric conduction performed by the inclined coil spring 13 and the possibility that minute foreign metal pieces generated by friction between the insulating ring 14 and the inclined coil spring 13 affect the insulation performance of the gas insulated switchgear badly, it is preferable that the insulating ring 14 is made of insulating resin such as Teflon® or glass epoxy resin. It is needless to say that the insulating ring 14 can be made of metal. Alternatively, the insulating ring can be made of metal and only the surface of the insulating ring can be coated with insulating resin. When the insulating ring is a metal ring, local heat generation may take place when a current is passed, and an electric arc may occur due to accidental shunt of short-circuit currents.

The Z axis-direction width size Wd of the cross section of the insulating ring 14 is larger than the size T of the radial-direction thickness of the insulating ring. When the insulating ring is formed in this way, a radial-direction gap is secured between the inclined coil spring 13 and the insulating ring 14 even if the inclined coil spring 13 is inserted into the fitting hole 11*a* and is compressed in a radial direction to slant the coil further.

The inclined coil spring 13 is helically wound at a slant so that the shape of the inclined coil spring is an ellipse and the short axis of the ellipse forms an acute angle with the central axis line of the coil as illustrated in FIGS. 3 and 4. The inclined coil spring 13 is provided inside the annular groove 12*b* in a state where the long axis of the ellipse is directed to the Z axis direction of the shaft 12*a* of the second conductor 12 and the short axis of the ellipse is directed to the radial direction of the shaft 12*a* as illustrated in FIG. 3. Moreover, the axial-direction both ends of the insulating ring 14 are in contact with the long-axis inner circumference of the inclined coil spring 13.

When such a configuration is employed, the axial-direction both ends of the insulating ring 14 prevents the inclined coil spring 13 from being deformed in the long-axis direction and prevents the inclined coil spring 13 from being twisted in the annular groove 12*b*. Therefore, the inclined coil spring 13 will deform only in the short-axis direction. Moreover, because the inclined coil spring 13 is provided inside the annular groove 12*b* so that its short axis is directed to the radial direction of the shaft 12*a*, the annular groove 12*b* can be shallow. Therefore, it is not necessary to deeply machine the annular groove. In this way, the machining cost can be reduced and the cross section for electric conduction of the second conductor 12 can be increased.

As illustrated in FIG. 3, the axial-direction both ends of the insulating ring 14 are formed in the shape of a hemicycle. The curvature radius $R_1$ of the hemicycle is smaller than the curvature radius $R_2$ of the long-axis inner circumference of the inclined coil spring 13. By employing such a shape, it is possible to prevent the generation of pieces due to sliding friction between the insulating ring 14 and the inclined coil spring 13.

The axial-direction both ends of the insulating ring 14 are formed in the shape of a hemicycle in the embodiment. However, the shape of the axial-direction both ends is not necessarily limited to a hemicycle. For example, the cross section of the insulating ring 14 may be formed in the shape of a rectangle and an angular portion coming in contact with the inclined coil spring 13 may be chamfered.

As illustrated in FIG. 3, the annular groove 12*b* is formed so that the more a width thereof approaches a bottom thereof and the more the width becomes narrow, a gap is secured between the inclined coil spring 13 and a bottom surface 12*c* of the annular groove 12*b*, a top portion 13*a* of the inclined coil spring 13 is protruded from the annular groove 12*b*, and the inclined coil spring 13 is in contact with lateral surfaces 12*d* and 12*e* of the annular groove 12*b* to be caught in the annular groove. Such a structure is advantageous because electric contact resistance is reduced when the inclined coil spring 13 is in contact with the second conductor 12 at two points.

Moreover, the angle of inclination of the lateral surfaces 12*d* and 12*e* of the annular groove 12*b* is set to an acute angle, a conducting distance of the wire of the inclined coil spring 13 is shortened and a contact pressure is increased, and electric resistance and electric contact resistance of the inclined coil spring are reduced. The more the angle of inclination of the lateral surfaces 12*d* and 12*e* of the annular groove 12*b* approaches 90 degrees (a right angle), the better the electric conduction performance becomes. However, the inclined coil spring 13 easily falls into the bottom surface 12*c* of the annular groove 12*b*, and the electric conduction performance becomes unstable when the inclined coil spring 13 easily falls. Therefore, it is preferable that the angle of inclination be somewhat smaller than 90 degrees in consideration of the fluctuation of a component tolerance. Moreover, the lateral surfaces 12*d* and 12*e* of the annular groove 12*b* are plane surfaces in the embodiment. However, the lateral surfaces 12*d* and 12*e* can be curved surfaces.

As illustrated in FIG. 3, the width size Wc of the long-axis outer circumference of the inclined coil spring 13 is smaller than the width size Wa of the upper edge of the annular groove 12*b* and is larger than the width size Wb of the bottom. In this manner, because of the above-mentioned geometry between the inclined coil spring 13 and the annular groove 12*b*, the rigidity of the insulating ring 14, and the behavior caused by an electromagnetic force during assembling the contact 10 or during applying currents to the contact 10, it is possible to prevent the inclined coil spring 13 from being twisted in the annular groove 12*b* and coming in contact with the bottom surface 12*c* of the annular groove 12*b*. Therefore, it is possible to prevent electric resistance from increasing or becoming unstable in the contractor 10.

As illustrated in FIG. 6, the insulating ring 14 has a cut portion 14*a* of a width that is slightly wider than the wire diameter d of the inclined coil spring 13 so that the insulating ring 14 is inserted into the inclined coil spring 13. The cut portion 14*a* is slanted to the Z axis direction of the shaft 12*a*. The circumferential-direction length $L_1$ of the cut portion 14*a* is larger than the helically-wound pitch $L_2$ of the inclined coil spring 13. Therefore, the insulating ring 14 abuts on all coils of the inclined coil spring 13 thereby preventing deformation of the coils.

Figure 7:
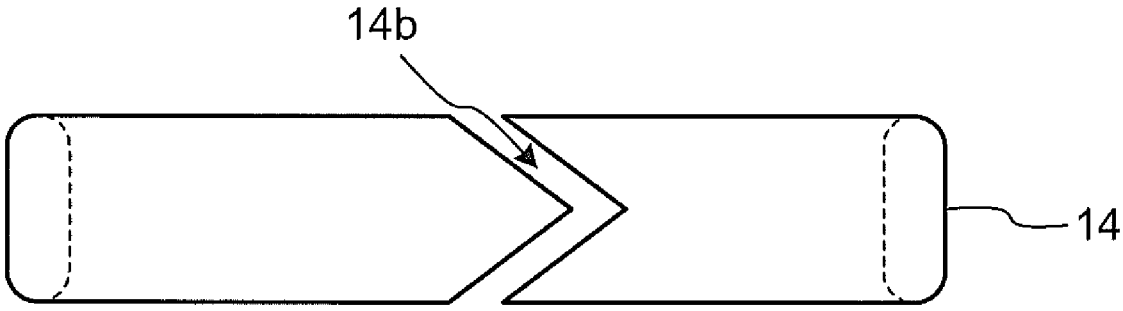
FIG. 7 is a bottom view of another example of a cut portion of the insulating ring.

As illustrated in FIG. 2, the cut portion 14*a* of the insulating ring 14 is shifted in a circumferential direction from a confronting portion 13*b* of the both ends of the inclined coil spring 13 and is arranged at the shifted position. It is preferable that the shifting angle be 180 degrees. Because the cut portion 14*a* and the confronting portion 13*b* that are structurally weak portions are arranged away from each other, the inclined coil spring 13 and the insulating ring 14 can have strong built-up structure. Furthermore, the inclined coil spring 13 can be prevented from falling off from the cut portion 14*a* of the insulating ring 14. Alternatively, the cut portion of the insulating ring 14 can be a V-shaped cut portion 14*b* as illustrated in FIG. 7 instead of the linear cut portion 14*a* illustrated in FIG. 6.

INDUSTRIAL APPLICABILITY

As described above, the contact according to the present invention is useful for a gas insulated switchgear used in a high-voltage transmission system.

The invention claimed is:

1. A contact comprising:

a first conductor that has a fitting hole formed therein;

a second conductor that has a shaft that can be inserted into the fitting hole and an annular groove formed on an outer circumference of the shaft; and an inclined coil spring that has a ring inserted into a coil, is circularly formed by the ring to be provided inside the annular groove, and is in contact with the annular groove and the fitting hole to electrically connect the first and second conductors.

2. The contact according to claim 1, wherein a size of an axial-direction width of a cross section of the ring is larger than a size of a radial-direction thickness.

3. The contact according to claim 2, wherein the inclined coil spring is helically wound in a shape of an ellipse and is provided inside the annular groove so that a long axis of the ellipse is directed to an axial direction of the shaft and a short axis is directed to a radial direction of the shaft, and axial-direction both ends of the ring are in contact with a long-axis inner circumference of the inclined coil spring.

4. The contact according to claim 3, wherein the axial-direction end of the ring is formed in a shape of a hemicycle, and a curvature radius of the hemicycle is smaller than a curvature radius of the long-axis inner circumference of the inclined coil spring.

5. The contact according to claim 3, wherein the annular groove is formed so that the more a width thereof approaches a bottom thereof and the more the width becomes narrow, a gap is between the inclined coil spring and a bottom surface of the annular groove, a top portion of the inclined coil spring is protruded from the annular groove, and the inclined coil spring is in contact with a lateral surface of the annular groove to be caught in the annular groove.

6. The contact according to claim 5, wherein a width size of a long-axis outer circumference of the inclined coil spring is smaller than a width size of an upper edge of the annular groove and is larger than a width size of the bottom of the annular groove.

7. The contact according to claim 1, wherein the ring has a cut portion that is slanted to an axial direction of the shaft of the second conductor.

8. The contact according to claim 7, wherein a circumferential-direction length of the cut portion of the ring is larger than a helically-wound pitch of the inclined coil spring.

9. The contact according to claim 7, wherein the cut portion of the ring is shifted in a circumferential direction from a confronting position of both ends of the inclined coil spring and is arranged at a shifted position.

10. The contact according to claim 1, wherein the ring is an insulating ring.

11. A contact comprising:

a first conductor with a fitting hole at an end thereof, a central axis of the fitting hole coincides with a central axis of the first conductor;

a second conductor with a shaft at one end thereof, the shaft provided with an annular groove formed on an outer circumference, the shaft configured to be inserted into the fitting hole of the first conductor; and an inclined coil spring assembly including a rigid ring member configured to be inserted into a coil member, the coil member being held in a circular shape by the rigid ring when the rigid ring member is inserted into the coil member, the inclined coil spring assembly configured to be arranged inside the annular groove in the second conductor, and the first conductor and the second conductor configured to be in electrical contact via the inclined coil spring assembly when the inclined coil spring assembly is arranged inside the annular groove and the shaft of the second conductor is inserted into the fitting hole of the first conductor.

* * * * *